US008633364B1

(12) United States Patent
Micheletti

(10) Patent No.: US 8,633,364 B1
(45) Date of Patent: Jan. 21, 2014

(54) STRUCTURAL SUPPORT FOR A STRINGED MUSICAL INSTRUMENT AND METHOD OF UTILIZING THE SAME FOR FABRICATION OF A MUSICAL INSTRUMENT

(76) Inventor: Richard Micheletti, Willits, CA (US)

( * ) Notice: Subject to any disclaimer, the term of this patent is extended or adjusted under 35 U.S.C. 154(b) by 162 days.

(21) Appl. No.: 13/291,864

(22) Filed: Nov. 8, 2011

Related U.S. Application Data

(60) Provisional application No. 61/420,286, filed on Dec. 6, 2010.

(51) Int. Cl.
*G10D 3/00* (2006.01)

(52) U.S. Cl.
USPC ..... 84/291

(58) Field of Classification Search
USPC ..... 84/267, 290, 291
See application file for complete search history.

(56) References Cited

U.S. PATENT DOCUMENTS 8,440,042 B2 * 5/2013 Ryan ..... 156/253

* cited by examiner

*Primary Examiner* — Kimberly Lockett
(74) *Attorney, Agent, or Firm* — James M. Duncan, Esq.; Klein DeNatale Goldner

(57) ABSTRACT

A musical instrument includes a top, a rigid front member with first and second seats and defining at least a portion of the front perimeter of the instrument, a back, a rigid rear member with first and second seats and defining at least a portion of the rear perimeter of the instrument, and a side extending between the rigid front member and the rigid rear member. The first seat of the rigid front member is adapted to receive an edge of the top, and the first seat of the rigid rear member is adapted to receive an edge of the back. The second seats of the rigid front member and rigid rear member are adapted to receive opposing edges of the side.

13 Claims, 10 Drawing Sheets

STRUCTURAL SUPPORT FOR A STRINGED MUSICAL INSTRUMENT AND METHOD OF UTILIZING THE SAME FOR FABRICATION OF A MUSICAL INSTRUMENT

RELATED APPLICATIONS

This application claims benefit of U.S. Provisional Application No. 61/420,286, filed on Dec. 6, 2010 and entitled "Structural Support for a Stringed Musical Instrument and Method of Utilizing the Same for Fabrication of a Musical Instrument," incorporated herein by reference in its entirety.

BACKGROUND OF THE INVENTION

1. Field of the Invention

The present invention relates generally to musical instruments, and more particularly to a rigid structural member for a stringed musical instrument.

2. Background

The present invention generally relates to acoustic stringed instruments, namely steel string and nylon stringed guitars, acoustic bass guitars, mandolins, ukuleles, and other instruments which utilize kerfing liner for support of the top and back of the instrument. The instruments for which the kerfing is utilized comprise a fretboard (or fingerboard) upon which the strings are fingered with the fingers of a musician's first hand to produce a desired musical tone when the strings are plucked, picked, bowed or otherwise actuated by the musician's second hand. The instrument comprises a sound chamber, or body, in which sound waves generated by the plucked strings are amplified by the vibrations of the materials forming the sound chamber and emitted from the sound chamber.

The sound chamber has a front (also referred to as the soundboard), back, and sides. In general, the strings of these instruments are attached on one end of the string to a headstock of the instrument, which is positioned at the end of the neck extending from the sound chamber, with the opposite end of the string typically attached to a member called the bridge, which is attached to the soundboard. A member called a saddle is typically mounted on the bridge, where the saddle elevates the strings above the soundboard. The sides of the instrument's sound chamber generally comprise an upper bout, a waist, and a lower bout, where the lower bout is the large rounded bottom of the instrument, the upper bout is the smaller, rounded and convex shape at the top. Under the traditional design of acoustic guitars, the shape of the sound chamber is that of a number "8", with the upper half, i.e., the upper bout, being smaller than the bottom half, i.e., the lower bout. The upper bout and lower bout are separated by the "waist" of the guitar, which is the concave transition between the upper and lower bouts.

For a right handed player, the right hand is typically utilized for bowing, picking, strumming, or otherwise actuating the strings. For the remainder of this description, it will be assumed that the instrument is "right handed", i.e., built to be played by a right-handed person. However, correlating the description for a left-handed instrument only requires the assumption that the right hand is utilized for fingering the notes and the left hand is utilized for bowing, picking or strumming the strings.

The sides of the instrument may, for purposes of description, be identified with respect to the strings. The treble strings of the instrument are usually on the side of the instrument generally facing downward as the instrument is played, while the bass strings are on the side of the guitar generally facing upward as the instrument is played. Using the strings as a point of reference, the sides of the instrument may be referred to as the treble side and the bass side. With respect to the string orientation described above, the side of the instrument generally facing downward while played is considered as the treble side of the instrument and the side of the instrument facing upward is considered as the bass side of the instrument. The upper bout may therefore may be further described as having a treble side upper bout and a bass side upper bout and, likewise, the lower bout may be further described as having a bass side lower bout and a treble side lower bout.

For the typical right handed player, the upper bout of the instrument is adjacent to the player's left arm, and the lower bout is adjacent to the player's right arm. The left hand is utilized for fingering notes on the fretboard, where the fretboard is disposed on the neck of the instrument. For many stringed instruments, a portion of the fretboard cantilevers over the soundboard. The portion of the fretboard cantilevering over the soundboard is typically referred to as the fretboard extension.

Kerfing liner or "kerfing" is the term applied to flexible strips of wood which are attached, usually with glue, to the inside edge of a wood support structure where a wood face or top member or a wood back or bottom member is attached in full or partial closure of the support structure, typically when the wood support structure is fabricated of relatively thin-walled material. In the usual application, the kerfing will provide additional contact area for providing a gluing surface where a relatively strong bond between the wood members is required. When applied, this strip of wood provides a wider surface to support the face member and/or back member which is attached to the kerfing by glue or other attachment means. Without the support provided by the kerfing there is not enough width on the sides to create a strong enough joint to hold the two thin plates together with glue (or other attachment means), because each plate typically has a thickness of approximately 0.075 to 0.090". The kerfing typically provides a "seat" or "shelf" of approximately 0.190" to support the top member and back member.

In one common application, kerfing is utilized for attaching the front and back members of a musical instrument to the sides of the instrument, such as with guitars, mandolins, acoustic bass guitar, or other stringed instrument utilizing a sound chamber as described above.

The top, back and sides of an acoustic guitar typically have a wall thickness of less than 0.120 inches, typically ranging from 0.075 to 0.090 inches. Because of the thin wall thickness, the available gluing surface for attaching the front and back of the guitar to the sides is quite small. To provide greater strength to this joint, the kerfing is attached, usually with glue, to the inside edge of the sides of the guitar which provides additional support and surface area for gluing. This strip of wood is known as "kerfing." Under the traditional design, the soundboard and sides of the instrument are at a right angle to each other, defining a common edge. This common edge may have a binding material, such a wood, plastic, or other trim, which protects the corner of the soundboard and side from impact damage.

Acoustic stringed instruments, such as guitars, are constructed to physically and sonically vibrate the soundboard by driving various vibration frequencies of the soundboard by means of transferring vibration energy from a plucked string through the saddle and bridge directly into the soundboard which acts as a vibrating plate. Hence the vibrating soundboard creates sound wave energy. Higher frequency (treble) sound waves are produced and emitted directly off the top face of the soundboard. Lower frequencies (bass) are produced by the soundboard vibrating the air inside the guitar body, emitting the lower frequency sound waves through the sound hole. The greater the soundboard vibration, the greater the sound wave energy produced. Secondary but noticeable tonal sound energy waves also come from the vibrating sides and back of the guitar.

Under the traditional design for guitars, the exterior of the sound chamber has been symmetric, where the treble side and bass side are matching. However, over the years, instrument makers have modified the traditional design. One of the most common of these modifications, which results in an asymmetrical sound chamber, has been to fashion a "cut-away" into the treble side of the upper bout and upper portion of the soundboard adjacent to the neck on the treble side to allow the player greater access to the portions of the fretboard adjacent to the body of the guitar. Other modifications have also been made, such as placing the sound hole in a different position than directly under the strings or, as discussed in greater detail below, modifying the normally right-angled edges between the sides, soundboard, and/or back to form a beveled edge. Another known modification is the inclusion of an ergonomic "armrest" or "bevel" (hereinafter, collectively, "bevels") which may be constructed into the connection of the soundboard and sides, where the bevel comprises a transitional member from the soundboard into the side. The bevel will generally be located on the bass side of the lower bout section of the guitar. Construction of the bevel can be complicated, often requiring substantial modifications in how the soundboard is supported.

Musical instruments which are constructed by attaching the soundboard and back of the instrument to a seat fabricated from kerfing, as described above, utilize a joint which is subject to losing sound energy because it is not as stiff as it might otherwise be constructed. However, increasing stiffness by increasing the width of the kerfing reduces the available area of soundboard for vibration, thus creating a stiffer and less resonant vibrating plate.

In addition to the issues discussed above, the kerfing typically utilized in instrument construction is not easy to work with, requiring additional time for the artisan to build a musical instrument. The existing kerfing has limited flexiblity. Musical instruments generally have many curved surfaces which often have a radius which is too tight to allow the kerfing to bend or conform to the curved surface without breaking. Thus, the artisan is often required to use sections of kerfing to complete the curved surface.

SUMMARY OF THE INVENTION

The present invention provides a musical instrument having a top, a rigid front member with first and second seats and defining at least a portion of the front perimeter of the instrument, a back, a rigid rear member with first and second seats and defining at least a portion of the rear perimeter of the instrument, and a side extending between the rigid front member and the rigid rear member. The first seat of the rigid front member is adapted to receive an edge of the top, and the first seat of the rigid rear member is adapted to receive an edge of the back. The second seats of the rigid front member and rigid rear member are adapted to receive opposing edges of the side.

Another aspect of the present invention provides that the rigid front member may include a plurality of laminated lengths of wood. Each of the plurality of laminated lengths of wood is fixedly attached to another of the laminated lengths of wood.

Another aspect of the present invention provides that the rigid front member define at least a portion of a bout of the instrument. The rigid front member may be thicker along at least a portion of the bout to form an ergonomic surface.

Another aspect of the present invention provides that the rigid rear member defines at least a portion of a bout of the instrument. The rigid rear member may be thicker along the at least a portion of the bout to form an ergonomic surface.

Another aspect of the present invention provides that the rigid front member and rigid rear member may be constructed from laminated lengths of wood attached to one another, a single length of wood sized and shaped to form the member, carbon fiber, or plastic.

Another aspect of the invention provides that the rigid front member defines a front perimeter of the instrument and includes a third seat disposed at the interior of the instrument. The rigid rear member defines a rear perimeter of the instrument and includes a third seat disposed at an interior of the instrument. An interior wall is attached to the third seat of the rigid front member and the third seat of the rigid rear member, creating a smaller sound chamber than created by the top, back, and side of the instrument.

Another aspect of the invention provides a musical instrument having a top, a side, and a rigid front member defining at least a portion of a front perimeter edge of the instrument. The rigid front member is fixedly attached to the top and side to form at least a portion of a sound chamber of the instrument.

Another aspect of the invention provides that the side and top together fully form a sound chamber of the instrument.

Another aspect of the present invention provides a method of making the embodiments of the instruments described herein.

DETAILED DESCRIPTION OF THE INVENTION

Figure 1:
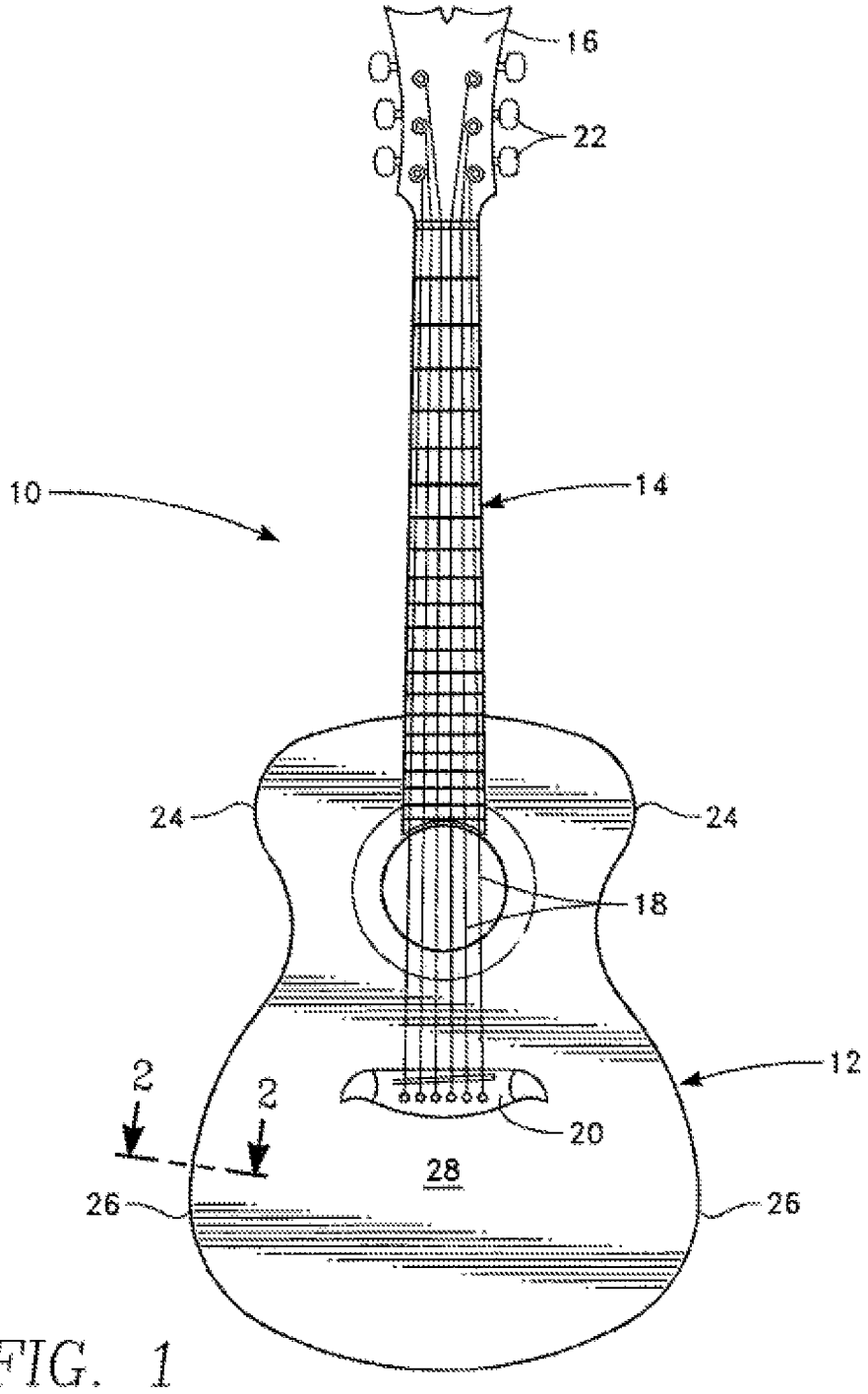
FIG. 1 shows a front view of a prior art guitar.

The disclosed invention comprises a rigid exterior frame which replaces the internally mounted kerfing currently utilized in musical instrument construction. In one embodiment of the present invention, the exterior frame comprises a front member which attaches the soundboard to the sides, and a rear member which attaches the back of the instrument to the sides. The front member may comprise a widened section at the bass side of the lower bout section of the guitar providing an ergonomic surface at the edge of the instrument, similar to the bevels described above. The front member may also be widened at the area where the musician's picking or strumming hand might rest, providing additional comfort to the musician. The back member may also comprise a widened section, which may provide greater comfort and support for an instrument which is played in the seated position.

The front member and back member may be fabricated from wood strips by bending the individual strips by methods known to those skilled in the art, and then laminating the strips together by gluing the strips together within a mold. Within various segments of the front and back member, extra laminations may be added to provide the widened ergonomic surfaces discussed above. Alternatively, the front member and back member may be fabricated from plastic materials utilizing injection molding techniques. Alternatively, the front and back member may be fabricated from solid pieces of wood, however fabricating solid wood members into the necessary configurations is likely to be expensive and presents significant manufacturing difficulties.

In known construction methods for custom instruments, such as guitars, the sides are fabricated, with kerfing, headblock and tail block glued in place, at which point the soundboard and back are glued in place. Prior art instruments typically have binding material placed around the outside edges for protecting the edges where the soundboard, back and sides are joined, which requires the machining of a groove at each edge for placement of the binding. The present invention provides a different method of fabrication, where the soundboard is attached to the front member forming a front assembly, the back attached to the back member forming a back assembly, and the preformed sides, headblock, and tail block glued to either the front assembly or back assembly. Because the front member and back member extend outwardly from the edges where the soundboard and back are joined to the sides of the instrument, no binding material is necessary to protect the edges.

The present invention achieves several objectives and advantages. Having the rigid frame at the outer perimeter of the soundboard and back plate focuses the energy of the driven string vibrations to the rigid frame members, allowing a greater magnitude of movement of the sound production members of the instrument, namely the soundboard and the back member.

The ergonomic features of the present invention are more easily fabricated than the known methods of fabricating bevels. The present invention eliminates the need for binding material to protect the edges of the instrument, thereby simplifying the construction process.

The present invention also provides a means by which a smaller bodied instrument becomes more comfortable for a larger sized musician. For example, classical guitars, having nylon strings, typically have smaller bodies than steel string acoustic guitars, such that the soundboard has a smaller area. Because the soundboard of the classical guitar is driven by lower tensioned nylon strings, having too large a soundboard or sound chamber can cause a muddy sound, or fail to produce clear and articulate tones. Thus, the size of classical guitars is naturally limited by the size of the soundboard and/or the size of the sound chamber. As a result, a larger player playing a classical guitar can be uncomfortable because of the relatively small size of the guitar body. However, the present invention, while not increasing the size of the soundboard, results in a guitar body having a larger size than a classical guitar. For example, a guitar having a soundboard of an appropriate size for a classical guitar may have an outside shape the size of a jumbo guitar.

Turning now to the drawings, wherein like numerals indicate like parts, FIG. 1 shows a sample of the type of instrument for which the disclosed structural support prior may be utilized. FIG. 1 shows a prior art guitar 10 manufactured according to the known methods. The guitar 10 has sound chamber 12 to which is attached neck 14 which terminates in headstock 16. Strings 18 extend from bridge 20 to tuning machines 22. The instrument has upper bouts 24, lower bouts 26, and soundboard 28.

Figure 2A:
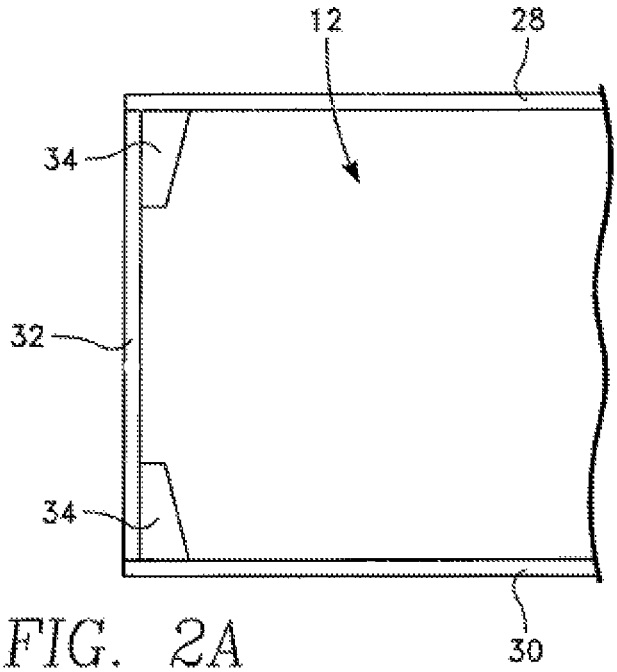
FIG. 2A shows a sectional view taken along line 2-2 of FIG. 1 for a guitar not having binding installed.
Figure 2B:
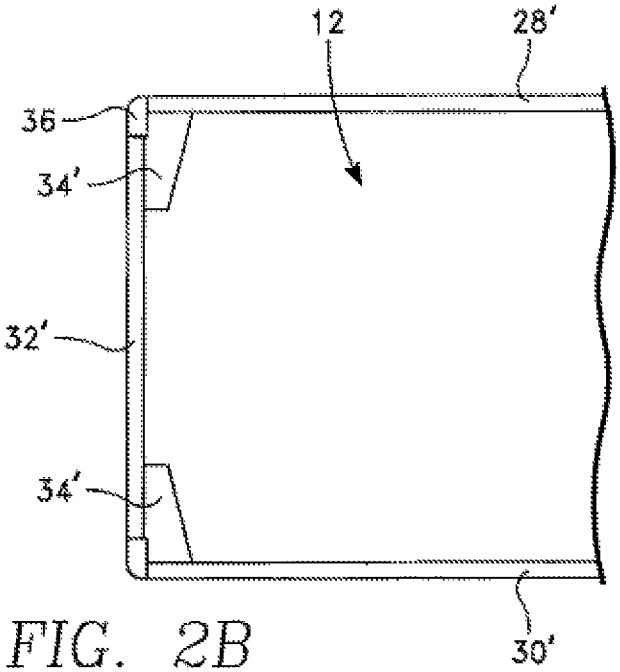
FIG. 2B shows a sectional view taken along line 2-2 of FIG. 1 for a guitar having binding installed.

FIG. 2A shows a sectional view taken along line 2-2 of FIG. 1. As shown in FIG. 2A, soundboard 28 and back plate 30 are joined to side 32 and supported by kerfing 34. It is to be appreciated that without kerfing 34, the only support for the soundboard 28 and back plate 30 would be the wall thickness of the side 32, which has a wall thickness of less than 0.120 inches, typically ranging from 0.075 to 0.090 inches. FIG. 2B shows a view along the same section lines of FIG. 1 but shows an instrument where the corners have been machined for placement of binding 36, which is installed to protect the square edges where the soundboard 28' and back plate 30' meet the side 32'.

Figure 3:
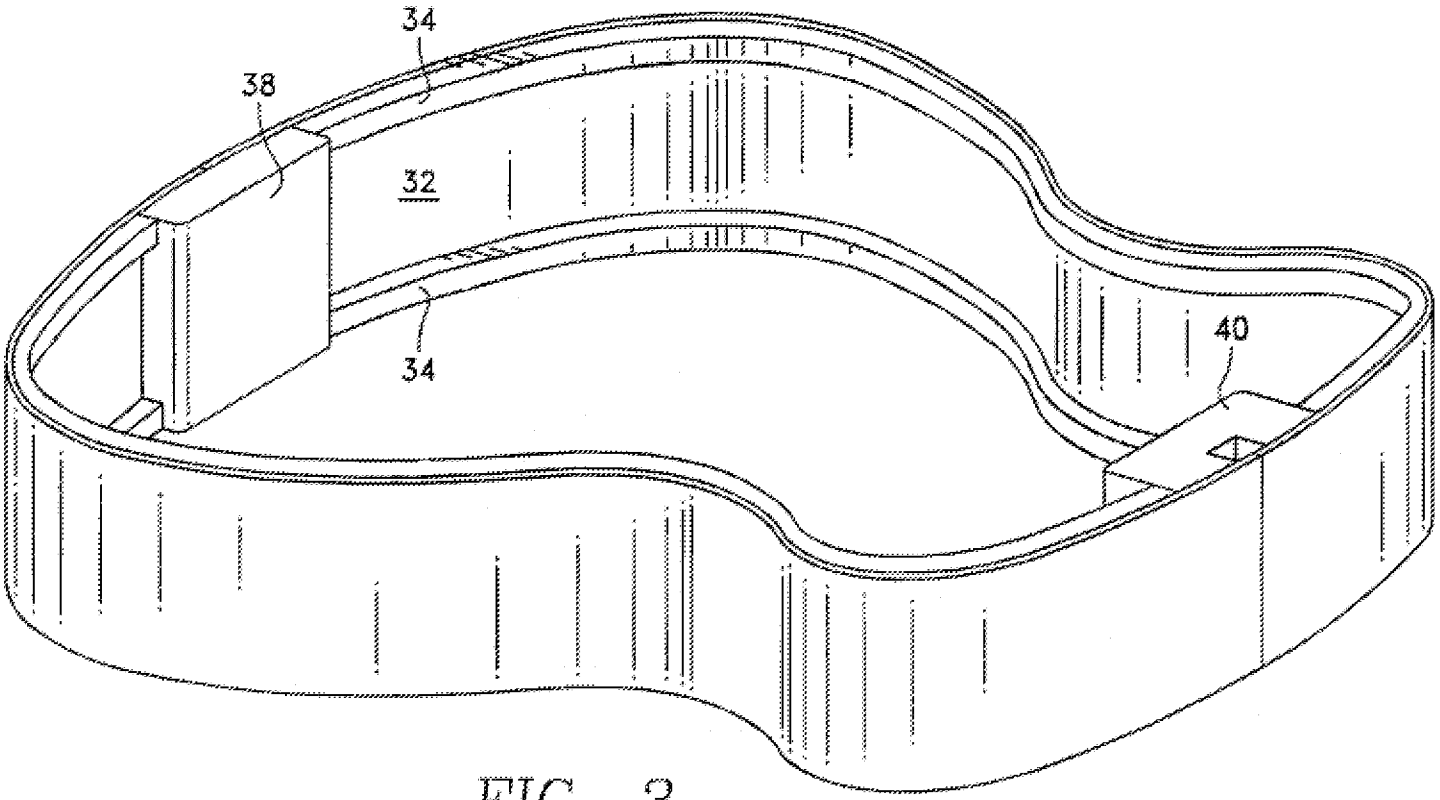
FIG. 3 shows a prior art guitar showing the placement of kerfing for supporting the soundboard and back.

FIG. 3 shows a partially constructed guitar 10 according to the known method, showing the sides 32 and showing the position of tail block 38 and head block 40. As shown in FIG. 3, kerfing 34 is required along the inside edges of the sides 32 at both the back and the front.

Figure 4:
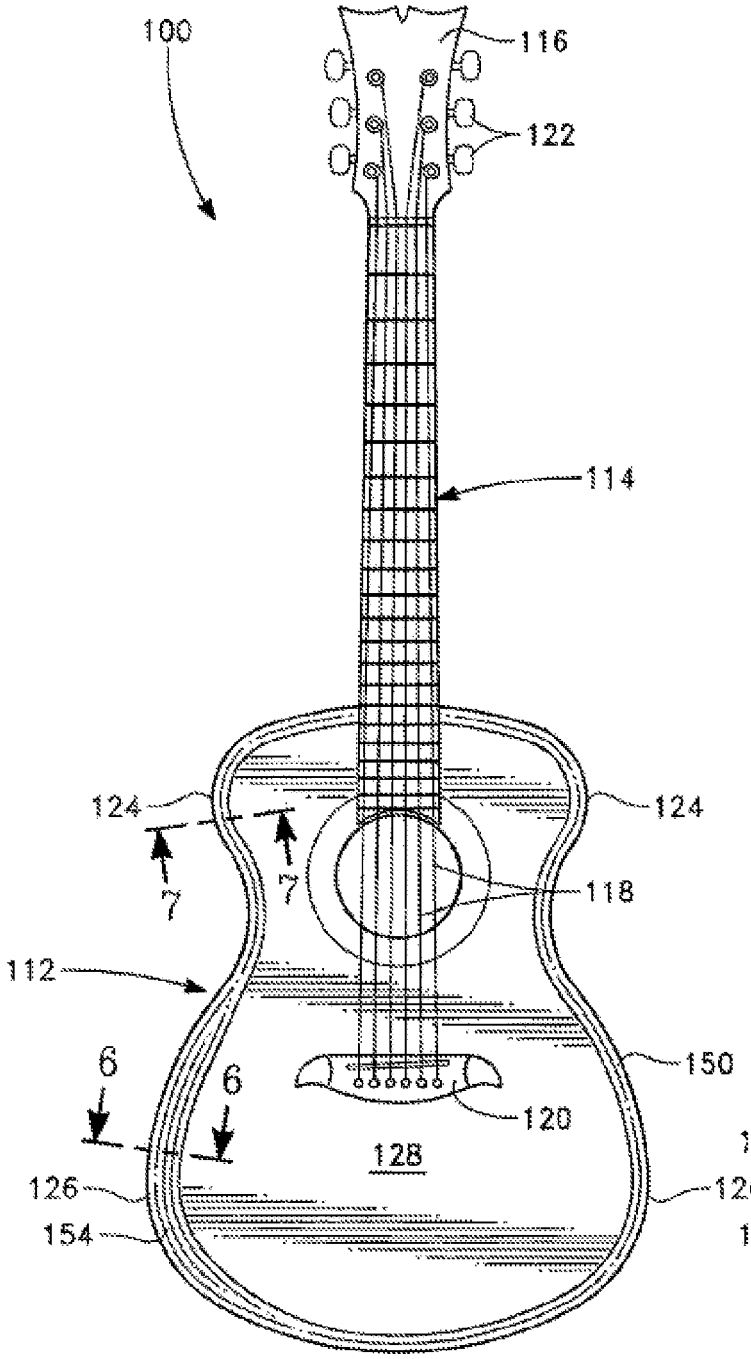
FIG. 4 shows a front view of a guitar having the disclosed structural support.
Figure 5:
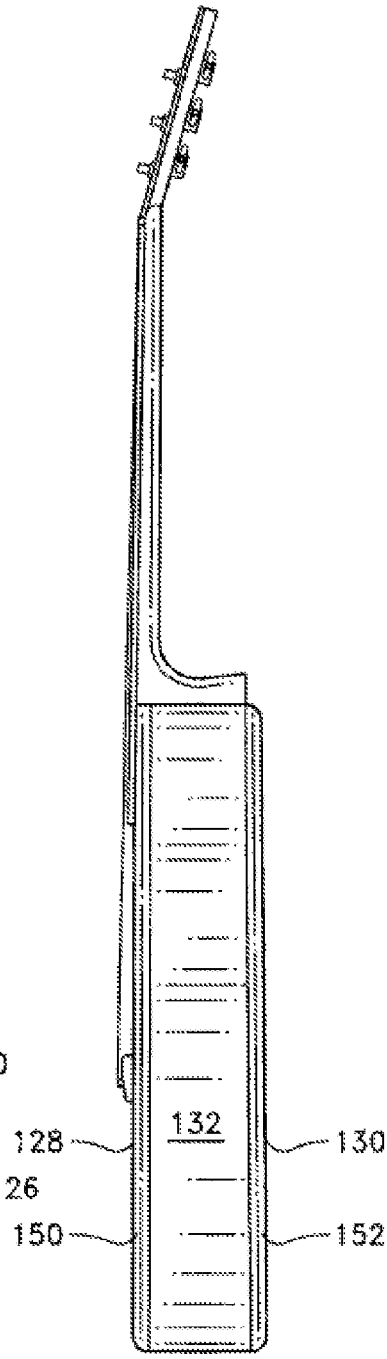
FIG. 5 shows a side view of the guitar shown in FIG. 4.
Figure 7:
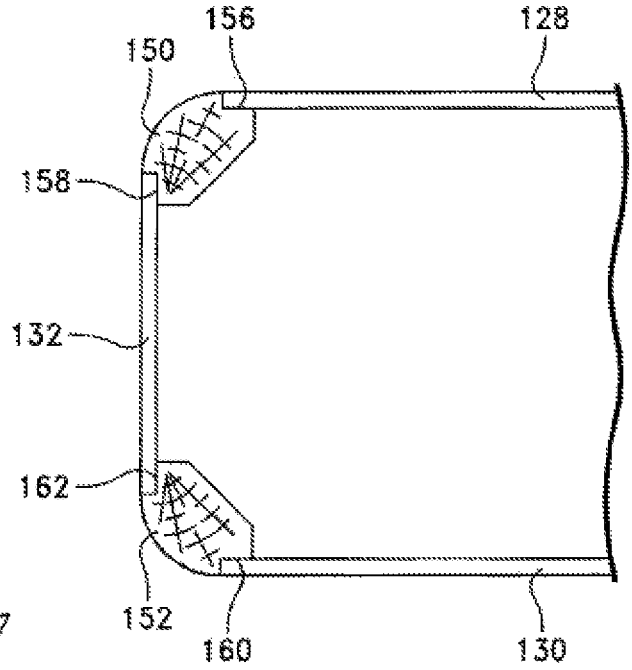
FIG. 7 shows a sectional view taken along line 7-7 of FIG. 4.
Figure 6:
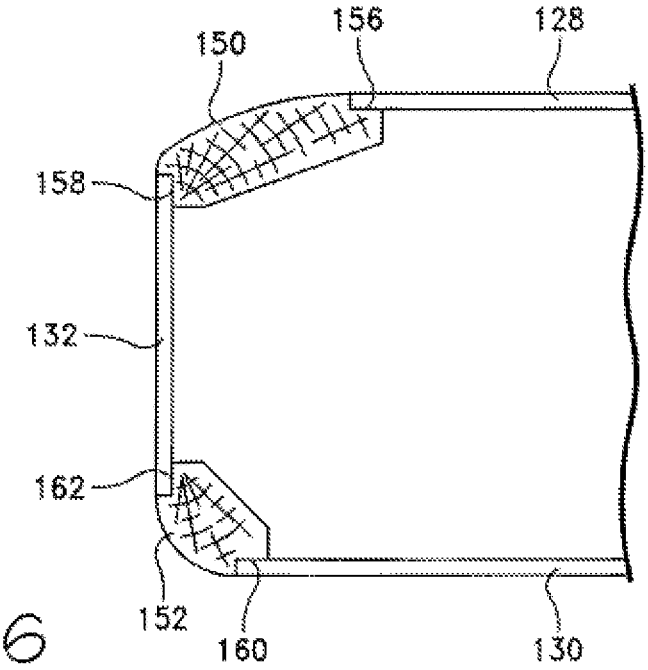
FIG. 6 shows a sectional view taken along line 6-6 of FIG. 4.

FIGS. 4 and 5 show an example of an instrument 100 fabricated utilizing the disclosed structural supports. The guitar has sound chamber 112 to which is attached neck 114 which terminates in headstock 116. Strings 118 extend from bridge 120 to tuning machines 122. The instrument has upper bouts 124, lower bouts 126, and soundboard 128. However, instead of utilizing kerfing 34 as with prior art instruments to support the soundboard 128 and back plate 130 to sides 132, embodiments of musical instruments fabricated according to the present invention utilize front member 150 and rear member 152 to join the soundboard and back plate to the sides. As shown in FIGS. 6 and 7, the front member 150 and rear member 152 may be fabricated in a laminate structure, which is achieved by gluing individual wood strips together. FIGS. 6 and 7 also show the first seat 156 formed in front member for placement of soundboard 128, and second seat 158 for attaching to side 132. Likewise, a first seat 160 is formed in rear member 152 for placement of back plate 130, while a second seat 162 is formed in the rear member for attaching to side 132.

FIG. 7 also shows how an ergonomic surface may be formed by utilization of additional laminated layers, thereby forming the wider surface shown in FIG. 4 and providing a soft edge where the musician's arm is typically rested across the lower bout 126, thus serving the same function as the beveled edges currently utilized. The present invention allows the edges of the instrument to be modified as desired anywhere along the perimeter of the front member 150 and/or rear member 152 by increasing the number of laminations.

Figure 8:
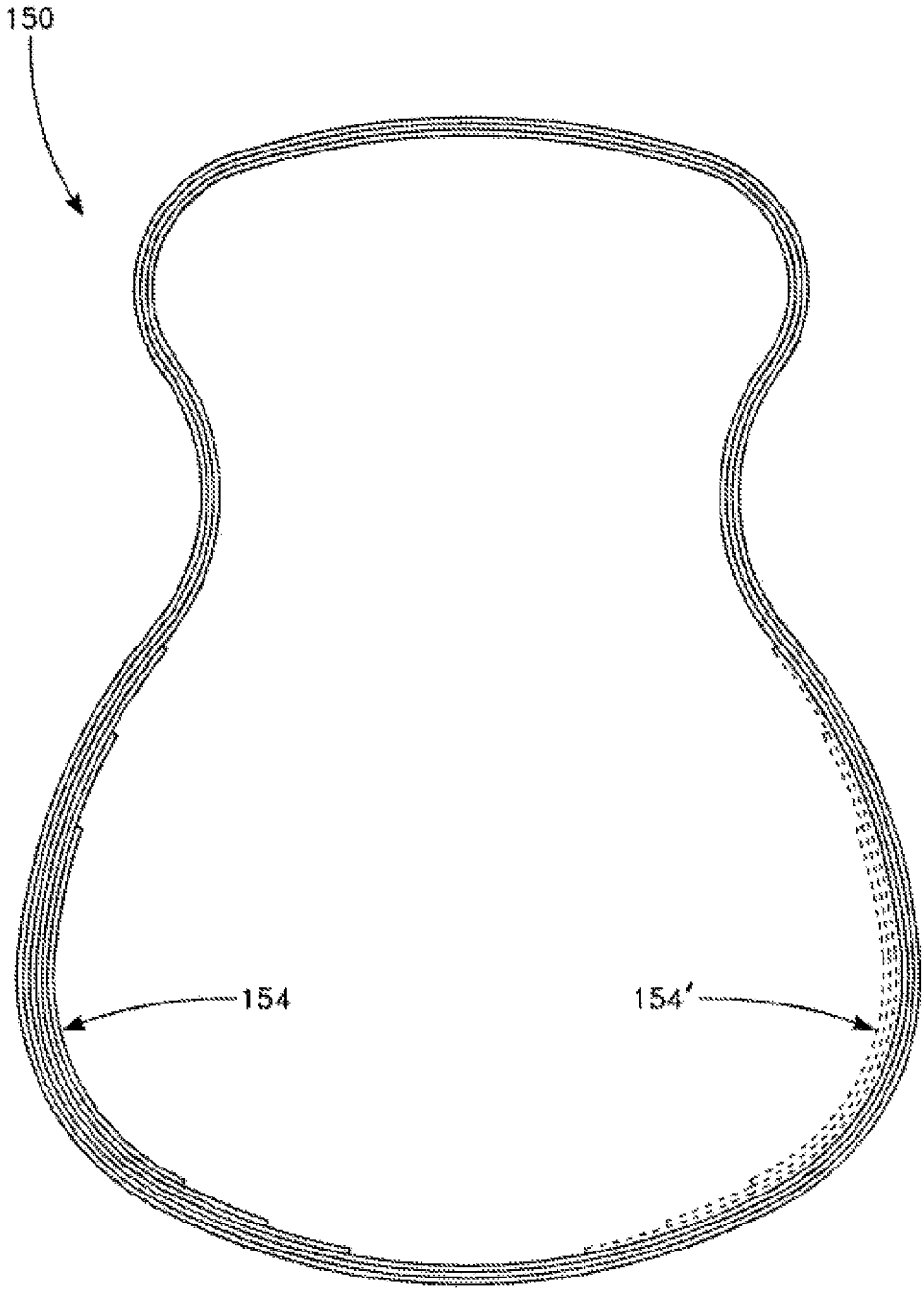
FIG. 8 shows an embodiment of the front frame member after shaping and lamination but prior to machining of the seat for the soundboard.

FIG. 8 shows a front member 150 formed from laminated lengths of wood which have been glued together, prior to the forming of the seats 156, 158. FIG. 8 shows the addition of layers at the area which will be adjacent to the lower bout 126 from which the ergonomic surface 154 may be fashioned.

Figure 9:
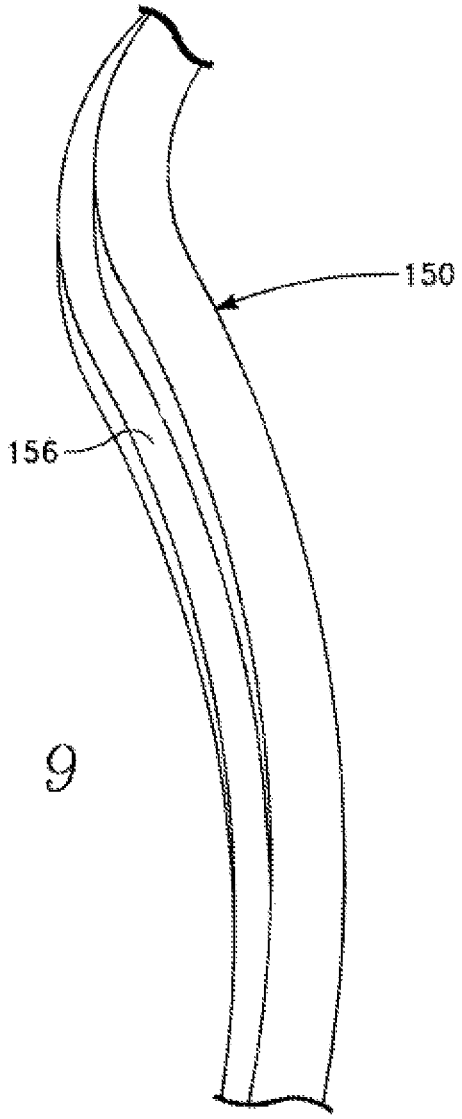
FIG. 9 shows a close up view of a portion of a frame member after the seat has been machined.

FIG. 9 shows a portion of the front member 150 after the seat 156 for placement of the soundboard has been fashioned.

Figure 10:
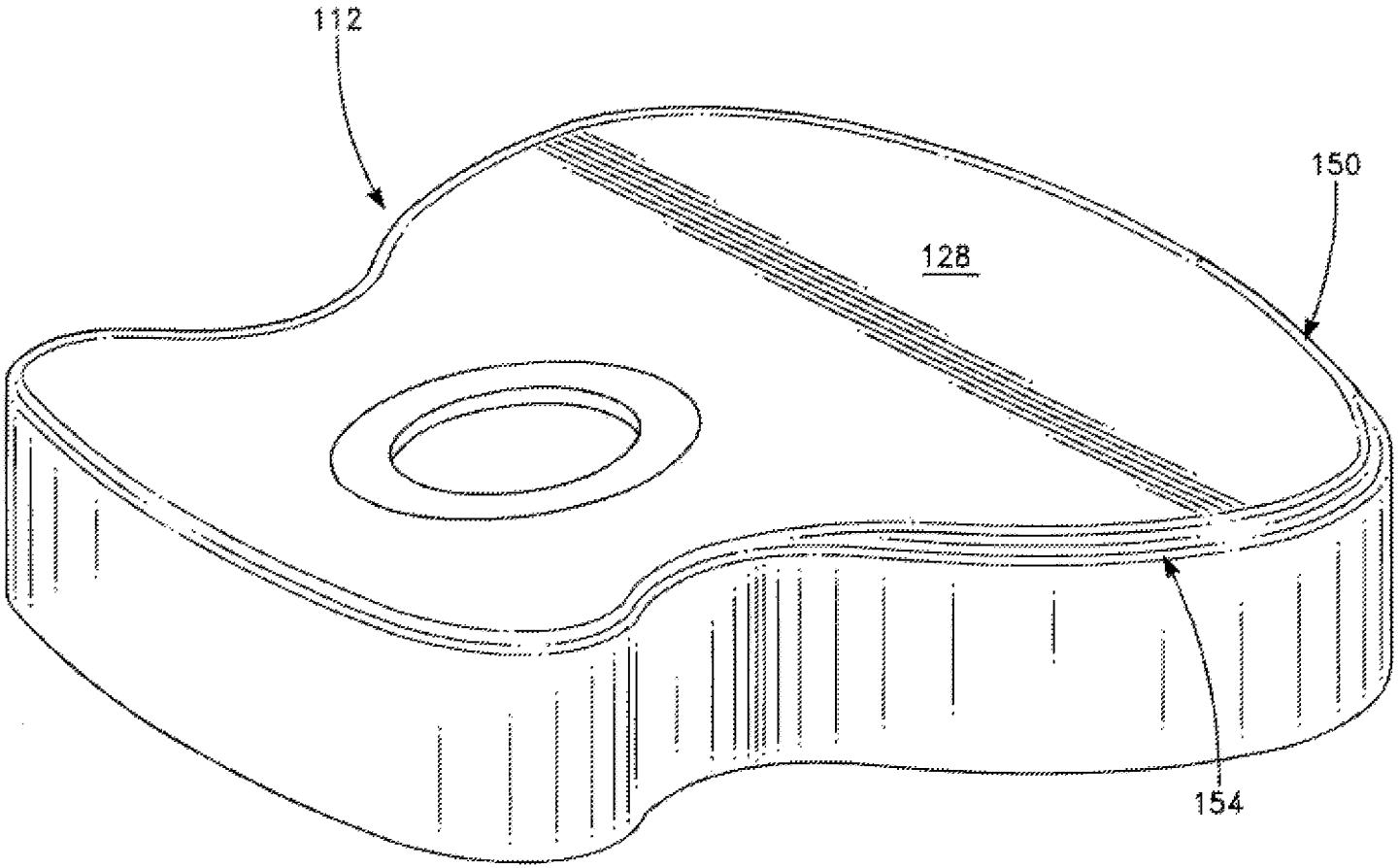
FIG. 10 shows a top view of a guitar body having been made with the disclosed structural support.

FIG. 10 shows a completed sound chamber 112, showing the front member 150 and the ergonomic surface 154. FIG. 10 further illustrates how the soft edges made possible by the present invention eliminates the need for binding or other materials for protecting the edges where the soundboard 128 is joined with the sides 132.

Figure 11:
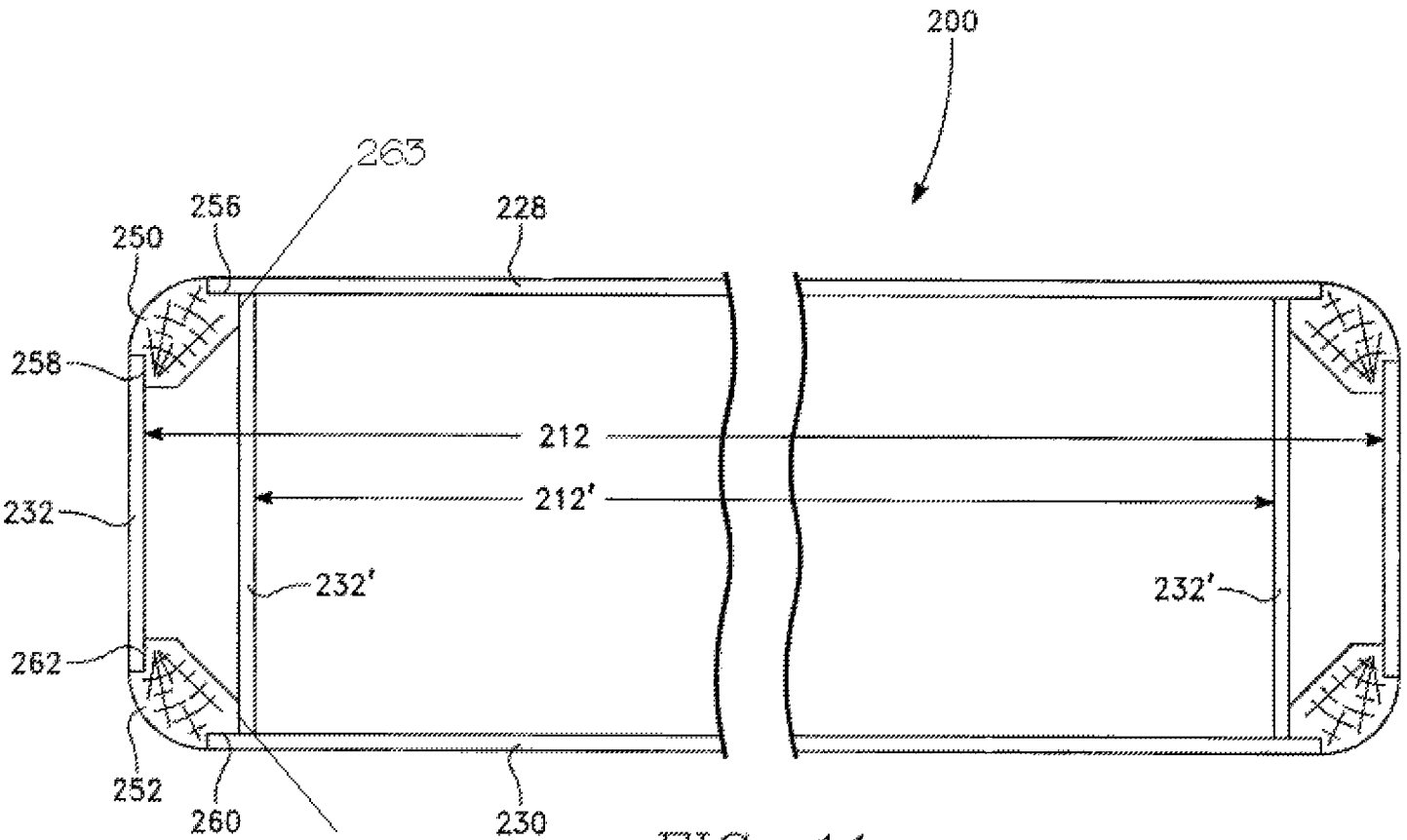
FIG. 11 shows a sectional view from FIG. 4 showing an embodiment of a classical guitar having an interior side member.

FIG. 11 shows an embodiment of a classical guitar 200 which may be fabricated according to the present invention. Classical guitars, having nylon strings, typically have smaller bodies than steel string acoustic guitars, such that the soundboard has a smaller area. Because the soundboard of the classical guitar is driven by lower tensioned nylon strings, having too large a soundboard can cause a muddy sound, or fail to produce clear and articulate tones. Thus, the size of classical guitars is naturally limited by the size of the soundboard. As a result, a larger player playing a classical guitar can be uncomfortable because of the relatively small size of the guitar body. However, the present invention, while not increasing the size of the soundboard, may be utilized to fabricate a guitar body having a larger size than a classical guitar as shown in FIG. 11. This embodiment of a classical guitar 200, which will be generally similar to the embodiment of the instrument 100 discussed above, may comprise sound chamber 212, which has a smaller volume than indicated by the exterior side walls. As shown in FIG. 11, the front member 250 and rear member 252 may be fabricated in a laminate structure, which is achieved by gluing individual wood strips together. FIG. 11 shows the seat 256 formed in front member 250 for placement of soundboard 228, and seat 258 for attaching to side 232. Likewise, a seat 260 is formed in rear member 252 for placement of back plate 230, while seat 262 is formed in the rear member for attaching to side 232. However, the classical guitar may include an interior wall 232' which is used to create a smaller sound chamber. Interior wall 232' may mate with a third seat 263 on each of rigid front member 250 and rigid rear member 252.

Figure 12:
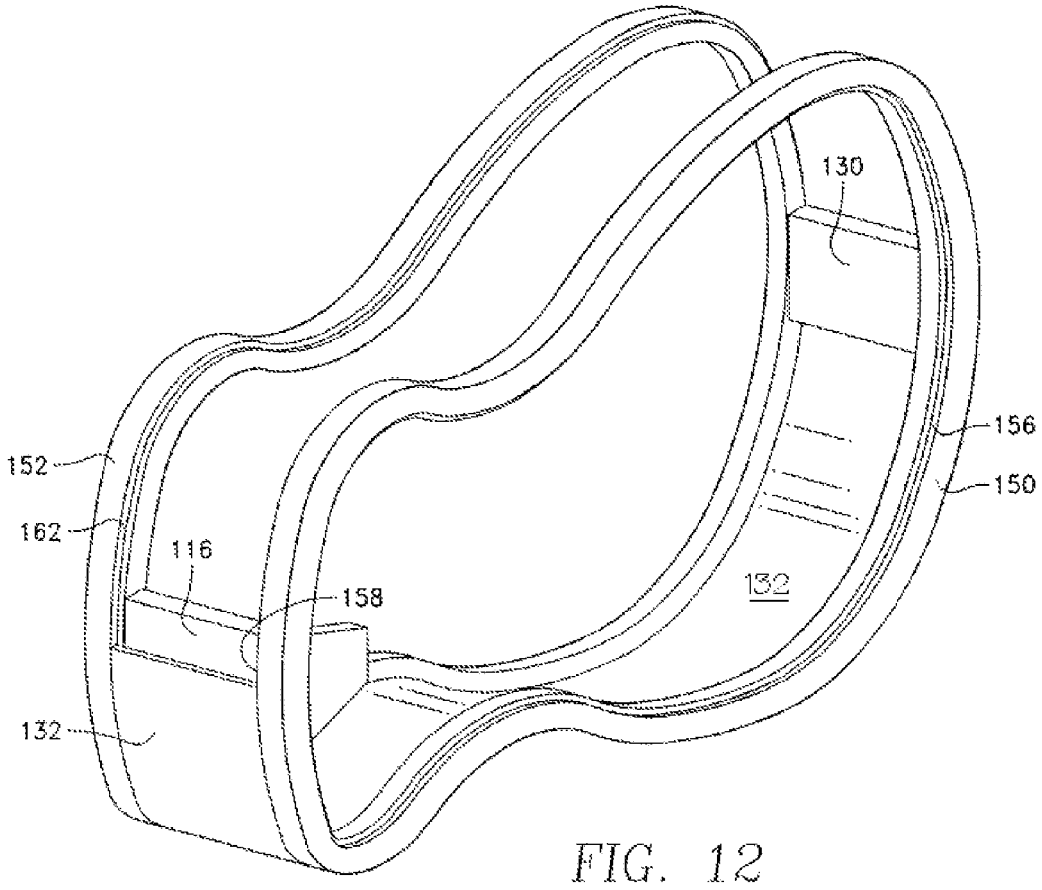
FIG. 12 is a perspective view of one embodiment of the present invention showing a rigid front member and rigid rear member forming the frame of an instrument.

FIG. 12 is a perspective view of one embodiment of the present invention. Front member 150 and rear member 152 act as a frame for construction of an instrument. Seat 156 is provided in front member 150 for attachment of a soundboard to the instrument. Seat 158 is provided in the front member for the attachment of side 132. Seat 162 is provided in the rear member for attachment of side 132. Headstock 116 and back plate 130 are shown extending between front member 150 and rear member 152.

It should be noted that some instruments for which the present invention is suitable do not have a discrete side and back. For examples, lutes and mandolins often have a single, rounded back and side rather than the discrete side and back of an acoustic guitar. For purposes of this application, the rounded back and side portion of a lute, mandolin, or other instrument will is referred to simply as a side, the side and top together forming the sound chamber of the device. With such instruments, it is contemplated that a single front member is utilized in accordance with the teachings of the present invention, as the rear member is not needed.

It is to be appreciated that while the above is a description of various embodiments of the present invention, further modifications may be employed without departing from the spirit and scope of the present invention. It is contemplated that such modifications will be readily apparent to one of skill in the art upon reading this disclosure. Thus the scope of the invention should not be limited according to these factors, but according to the claims that follow.

Having thus described the preferred embodiment of the invention, what is claimed as new and desired to be protected by Letters Patent includes the following:

1. A musical instrument comprising:

a top;

a rigid front member comprising a first seat and a second seat, the rigid front member defining at least a portion of a front perimeter edge of the musical instrument, the first seat of the rigid front member adapted to receive an edge of the top;

a back;

a rigid rear member comprising a first seat and a second seat, the rigid rear member defining at least a portion of a rear perimeter edge of the musical instrument, the first seat of the rigid rear member adapted to receive an edge of the back; and a side extending between the rigid front member and the rigid rear member, the second seat of the rigid front member and the second seat of the rigid rear member each adapted to receive an opposing edge of the side wherein the rigid front member defines at least a portion of a bout of the instrument, the rigid front member being thicker along at least a portion of the bout of the instrument to form an ergonomic surface thereon.

2. The musical instrument according to claim 1 wherein the rigid front member and rigid rear member comprise a plurality of laminated lengths of wood, each of the plurality of laminated lengths of wood fixedly attached to another of the laminated lengths of wood.

3. The musical instrument according to claim 1 wherein the rigid rear member defines at least a portion of a bout of the instrument, the rigid front member being thicker along at least a portion of the bout of the instrument to form an ergonomic surface thereon.

4. The musical instrument according to claim 1 wherein the rigid front member and rigid rear members are constructed from material selected from the group consisting of a plurality of lengths of wood fixedly attached to one another, a single length of wood sized and shaped to form the member, carbon fiber, and plastic.

5. The musical instrument according to claim 1 wherein the rigid front member defines a front perimeter edge of the instrument and comprises a third seat, the third seat of the rigid front member being disposed at an interior of the instrument, further wherein the rigid rear member defines a rear perimeter edge of the instrument and comprises a third seat, the third seat of the rigid rear member being disposed at an interior of the instrument, the instrument further comprising:

an interior wall attached to the third seat of the rigid front member and the third seat of the rigid rear member, the interior wall creating a smaller sound chamber than created by the top, back, and side of the instrument.

6. A musical instrument comprising:

a top;

a side; and a rigid front member defining at least a portion of a front perimeter edge of the instrument, the rigid front member being fixedly attached to the top and the side such that the top and the side form at least a portion of a sound chamber of the instrument wherein the rigid front member defines at least a portion of a bout of the instrument, the rigid front member being thicker along at least a portion of the bout of the instrument to form an ergonomic surface thereon.

7. The musical instrument according to claim 6 wherein the side is rounded and the top and side fully form the sound chamber of the instrument.

8. The musical instrument according to claim 6 wherein the rigid front member comprises a plurality of laminated lengths of wood, each of the plurality of laminated lengths of wood fixedly attached to another of the laminated lengths of wood.

9. The musical instrument according to claim 6 further comprising a rigid rear member defining at least a portion of a rear perimeter edge of the instrument, and a back, the rigid rear member being fixedly attached to the back and the side such that the top, side, and back form the sound chamber of the instrument.

10. The musical instrument according to claim 9 wherein the rigid rear member comprises a plurality of laminated lengths of wood, each of the plurality of laminated lengths of wood fixedly attached to another of the laminated lengths of wood.

11. The musical instrument according to claim 9 wherein the rigid rear member defines at least a portion of the bout of the instrument, the rigid rear member being thicker along at least a portion of the bout of the instrument to form an ergonomic surface thereon.

12. A method of making a musical instrument, the method comprising the steps of:

a) providing a top, back, and side having a top edge and a back edge;

b) providing a rigid front member comprising a first seat and a second seat, the rigid front member defining at least a portion of a front perimeter edge of the instrument;

c) providing a rigid rear member comprising a first seat and a second seat, the rigid rear member defining at least a portion of a rear perimeter edge of the instrument;

d) fixedly attaching the rigid front member, at a first seat thereof, to the top;

e) fixedly attaching the rigid front member, at a second seat thereof, to the top edge of the side;

f) fixedly attaching the rigid back member, at a first seat thereof, to the back;

g) fixedly attaching the rigid back member, at a second seat thereof, to the back edge of the side;

wherein the side extends between the rigid front member and the rigid rear member and the top, back, side, rigid front member, and rigid rear member define a sound chamber of the instrument.

13. The method according to claim 12 wherein the rigid front member comprises a third seat disposed at an interior of the instrument, and further wherein the rigid rear member comprises a third seat disposed at an interior of the instrument, the method further comprising the steps of:

h) providing an interior wall of the instrument, the interior wall having first and second opposing edges;

i) attaching the first edge of the interior wall to the third seat of the rigid front member; and j) attaching the second edge of the interior wall to the third seat of the rigid rear member, wherein the interior wall creates a smaller sound chamber of the instrument than would be created by the top, back, and side.

* * * * *